US005826223A

United States Patent [19]

Kim et al.

[11] Patent Number: 5,826,223

[45] Date of Patent: Oct. 20, 1998

[54] METHOD FOR GENERATING RANDOM CODE BOOK OF CODE-EXCITED LINEAR PREDICTIVE CODING

[75] Inventors: Hong-kook Kim, Suwon; Kee-eun Oh, Seoul; Moo-young Kim, Sungnam, all of Rep. of Korea

[73] Assignee: Samsung Electronics XCo., Ltd., Kyungki-do, Rep. of Korea

[21] Appl. No.: 756,581

[22] Filed: Nov. 27, 1996

[30] Foreign Application Priority Data

Nov. 29, 1995 [KR] Rep. of Korea ..... 95-44887

[51] Int. Cl.[6] ..... G10L 3/02; G10L 9/00

[52] U.S. Cl. ..... 704/221; 704/223; 704/219

[58] Field of Search ..... 704/219, 220, 704/221, 222, 223, 224

[56] References Cited

U.S. PATENT DOCUMENTS 5,457,783 10/1995 Chhatwal ..... 704/219

OTHER PUBLICATIONS

Campbell Jr. et al.; "The DOD 4.8 KBPS Standard (Proposed Federal Standard 1016)"; U.S. Government Dept. of Defense, Ft. Meade, MD, pp. 121–133.

*Primary Examiner*—David R. Hudspeth
*Assistant Examiner*—Robert Louis Sax
*Attorney, Agent, or Firm*—Leydig, Voit & Mayer, Ltd.

[57] ABSTRACT

A method for generating a random code book having a characteristic similar to a periodic component of voice in code-excited linear predictive (CELP) coding. The method includes generating an adaptive code book that removes the periodic component of a current subframe of a speech signal. An adaptive code book array is generated with respect to the current subframe on the basis of an optimal delay and gain obtained in generating the adaptive code book. A number of code word arrays are generated from the adaptive code book array and the excited signal of the immediately previous subframe. A code word that has the maximum value is selected from each code word array generated in the code word array generating step. Each code word array is normalized using the selected code word. The normalized maximum value in each code word array is selected and scaled by the power of the most previous frame. A random code book including a set of the scaled selected maximum values is generated. The method for generating a random code book generates a random code book using adaptive code book information, and, as a result, has the effect of providing improved synthesized sound compared with a conventional CELP coder.

3 Claims, 3 Drawing Sheets

METHOD FOR GENERATING RANDOM CODE BOOK OF CODE-EXCITED LINEAR PREDICTIVE CODING

BACKGROUND OF THE INVENTION

The present invention relates to a method for generating a random code book used in a code-excited linear predictive (CELP) coding method, and more particularly, to a method for generating a random code book which has a similar characteristic to the periodic component of a voice.

Generally, the pitch information and the formant information of a voice have values varying within an analysis section. These are important elements which dominate not only the periodicity of a voice but also the quality of a voice.

A CELP coder largely includes a pitch filter and a random code book. The pitch filter is used for removing the periodicity of a voice, and an adaptive code book is generally used to realize the pitch filter.

In addition, the remaining portion (a residual signal) of a voice that is not expressed by the pitch filter or the adaptive code book is modeled by a fixed random code book.

However it is difficult to model the periodicity of a voice completely because of the time-varying characteristic of a voice itself. Therefore when a signal from which the voice periodicity is removed is modeled in the conventional CELP coder, many bits must be assigned to the random code book to obtain the synthesized sound of high quality.

That is, to obtain the voice of high quality by using a reduced number of bits, it is desirable to use a code book based on the signal similar to the periodic component of a voice instead of the random code book.

FIG. 1 is a block diagram showing a conventional code-excited linear predictive (CELP) coder for explaining a CELP coding method. Referring to FIG. 1, in block 101, a predetermined section (frame) of a voice which is to be analyzed is sampled. Since one frame is generally 20–30 ms, one frame corresponds to 160–240 samples at the sampling rate of 8 kHz.

In block 102, high pass filtering to remove the DC component of the sampled voice signal of one frame is performed.

In block 103, the characteristic parameters ($\alpha_1, \alpha_2, \ldots, \alpha_p$) of the voice are obtained using the linear predictive method. This characteristic parameters (hereinafter, called LPC coefficients) correspond to the coefficients of a polynomial obtained in the approximation of the voice signal weighted by a window function using the linear polynomial of p order as shown in equation (1).

$$S_w(n)=S_p(n)W(n) \tag{1}$$

where, $$W(n) = 0.54 - 0.46\cos\left(\frac{2\pi n}{N-1}\right),$$

n=0, 1, . . . , N−1 and W(n) corresponds to the coefficients which minimize equation (2).

$$\sum_{n=0}^{(N-1)} (s_w(n) - \hat{s}(n))^2 \tag{2}$$

where $\hat{s}(n)=\alpha_1 s(n-1)+\alpha_2 s(n-2)+ \ldots +\alpha_p s(n-p)$.

In block 104, being before quantized and transmitted, the LPC coefficients obtained as above are converted to the line spectrum pairs (LSP) coefficients which improve the transmission efficiency and have a good subframe interpolation characteristics.

The LSP coefficients are quantized in block 105.

In block 106, LSP coefficients are inversely quantized to synchronize an encoder and a decoder.

To remove the periodicity of the voice from the voice parameters analyzed as above and to model to random code book, the voice section is divided into four subframes. That is, the voice section length of a respective subframe is $N/4=N_0$.

The i-th voice parameters $\omega_i^0$(s=0, 1, 2, 3, i=1, . . . , p) with respect to the s-th subframe can be obtained as the following equation (3).

$$\omega_i^s = \begin{cases} 0.25\omega_i(n-1) + 0.75\omega_i(n), & s=0 \\ 0.5\omega_i(n-1) + 0.5\omega_i(n), & s=1 \\ 0.75\omega_i(n-1) + 0.25\omega_i(n), & s=2 \\ \omega_i(n) \quad , & s=3 \end{cases} \tag{3}$$

where $\omega_i(n-1)$ and $\omega_i(n)$ represent the i-th LSP coefficients of the previous frame and the current frame, respectively.

The block 108 converts the line spectrum pairs (LSP) coefficients to the LPC coefficients. In blocks 109, 110 and 111, the voice synthesizing filtering and the error weighting filtering are performed with respect to the subframe LPC coefficients.

The voice synthesizing filter $$\frac{1}{A(z)}$$

and the error weighting filer $$\frac{A(z)}{A(z/\gamma)}$$

are obtained from the following equations (4) and (5).

$$\frac{1}{A(z)} = \frac{1}{1 - \alpha_1^s z^{-1} - \alpha_2^s z^{-2} - \ldots - \alpha_p^s z^{-p}} \tag{4}$$

$$\frac{A(z)}{A(z/\gamma)} = \frac{1 - \alpha_1^s z^{-1} - \alpha_2^s z^{-2} - \ldots - \alpha_p^s z^{-p}}{1 - \alpha_1^s \gamma z^{-1} - \alpha_2^s \gamma^2 z^{-2} - \ldots - \alpha_p^s \gamma^p z^{-p}} \tag{5}$$

where $\alpha_i^0$ is an LPC coefficients converted from LSP coefficients $\mathbf{107}_i^0$.

The block 109 removes the influence of the synthesizing filter of the previous subframe. The zero-input-response (ZIR), $S_{zir}(n)$ can be obtained from the following equation (6).

$$S_{zir}(n)=\alpha_1^8 S_{zir}(n-1)+\alpha_2^s S_{zir}(n-2)+ \ldots +\alpha_p^8 S_{zir}(n-p) \quad n=0,1, \ldots, N_0-1 \quad S_{zir}(-n)=\hat{S}(N_8-n) \quad n=1, \ldots, p \tag{6}$$

$\hat{S}(n)$ denotes a synthesis signal of the previous frame.

The result of ZIR is subtracted from the original voice signal $S_p(n)$, and the result is referred to as $S_d(n)$.

Blocks 111 through 114 correspond to the process of searching the most approximate code book to $S_d(n)$ among the adaptive code book and random code book.

FIG. 2 is a block diagram for explaining the code book generating process. The error weighting filter $$\frac{A(z)}{A(z/Y)}$$

corresponding to equation (5) is applied to the signal $S_d(n)$ and the voice synthesizing filter, respectively. In block 111

$S_d(n)$ is error-weighting-filtered and becomes $S_{dw}(n)$. In addition, if it is assumed that $P_L(n)$ is made using the adaptive code book and having the delay of L, the filtered signal in block 110 is $g_a P'_L(n)$ and L" and $g_a$ which minimize the difference of the two signals are obtained from the following equations (7)–(9).

$$e(n) = S_{dw}(n) - g_a \cdot P'_L(n) \tag{7}$$

$$L^* = \max_{20 \leq L \leq 147} \frac{\left(\sum_{n=0}^{N_n-1} S_{dW}(n)P'_L(n)\right)^2}{\sum_{n=0}^{N_n-1} P'_L(n)P'_L(n)} \tag{8}$$

$$g_a = \frac{\sum_{n=0}^{N_n-1} S_{dw}(n)P'_L(n)}{\sum_{n=0}^{N_n-1} P'_L(n)P'_L(n)} \tag{9}$$

The error signal obtained from L" and $g_a$ is $S_{ow}(n)$. This value equals to equation (10).

$$S_{cw}(n)=S_{dw}(n)-g_0P_L'.(n) \tag{10}$$

FIG. 3 is a block diagram for explaining the generating process of the random code book. If it is assumed that the i-th code word among the random code book constituted by M units is $C_i(n)$, the filtered signal in block 110 becomes $g_r.c'_1(n)$. The optimal code word and code book gains are equal to the following equations (11)–(13).

$$e(n) = S_{ew}(n) - g_r \cdot c'_i(n) \tag{11}$$

$$i^* = \max_{0 \leq i \leq M-1} \frac{\left(\sum_{n=0}^{N_n-1} S_{eW}(n)c'_i(n)\right)^2}{\sum_{n=0}^{N_n-1} c'_i(n)c'_i(n)} \tag{12}$$

$$g_r = \frac{\sum_{n=0}^{N_n-1} S_{ew}(n)c'_i(n)}{\sum_{n=0}^{N_n-1} c'_i(n)c'_i(n)} \tag{13}$$

The excited signal of the voice filter obtained finally is expressed by equation (14).

$$r(n)=g_a.P_L.(n)+g_r.c_{i'}(n) \tag{14}$$

The result of the equation (14) is used for updating the adaptive code book.

The encoder transmits the pitch, the line spectrum pairs (LSP) coefficients, the adaptive code book index L., gain $g_a$, the random code book index i., and gain $g_r$ to the decoder.

The defect of the CELP coding method described above is that the random code book is used as the same value with respect to all voice data. Accordingly, the capacity of the random code book dominates that of the CELP coder. In addition, the size M of the code word becomes much greater.

SUMMARY OF THE INVENTION

To overcome the above problem, it is the object of the present invention to provide an improved method for generating a random code book which can realize the synthesized sound of high quality in a CELP coder.

To achieve the above object of the present invention, there is provided a method for generating a random code book having a similar characteristic to the periodic component of each frame of a voice in a code-excited linear predictive (CELP) coding method, the method comprising the steps of:

(a) generating an adaptive code book which removes the periodic component of a current subframe;

(b) generating adaptive code book array with respect to a current subframe on the basis of the optimal delay and gain obtained in the adaptive code book generating step;

(c) generating a predetermined number of code word arrays on the basis of the adaptive code book array generated in the adaptive code book array generating step and the excited signal of the past subframe;

(d) selecting a code word which has the maximum value in each code word array generated in the code word array generating step and normalizing each code word array using the selected code word; and (e) selecting the maximum value in each code word array normalized in said normalizing step, scaling the selected maximum value by the power of the past frame, and generating a random code book which is a set of the scaled selected maximum value.

BRIEF DESCRIPTION OF THE DRAWINGS

The above object and advantages of the present invention will become more apparent by describing in detail a preferred embodiment thereof with reference to the attached drawings in which.

DETAILED OF THE INVENTION

In the present invention, the method for generating a random code book appropriate to the model of each frame of a voice is proposed. The proposed algorithm generates a random code book based on the adaptive code book information used for removing the periodicity of a voice.

Figure 1:
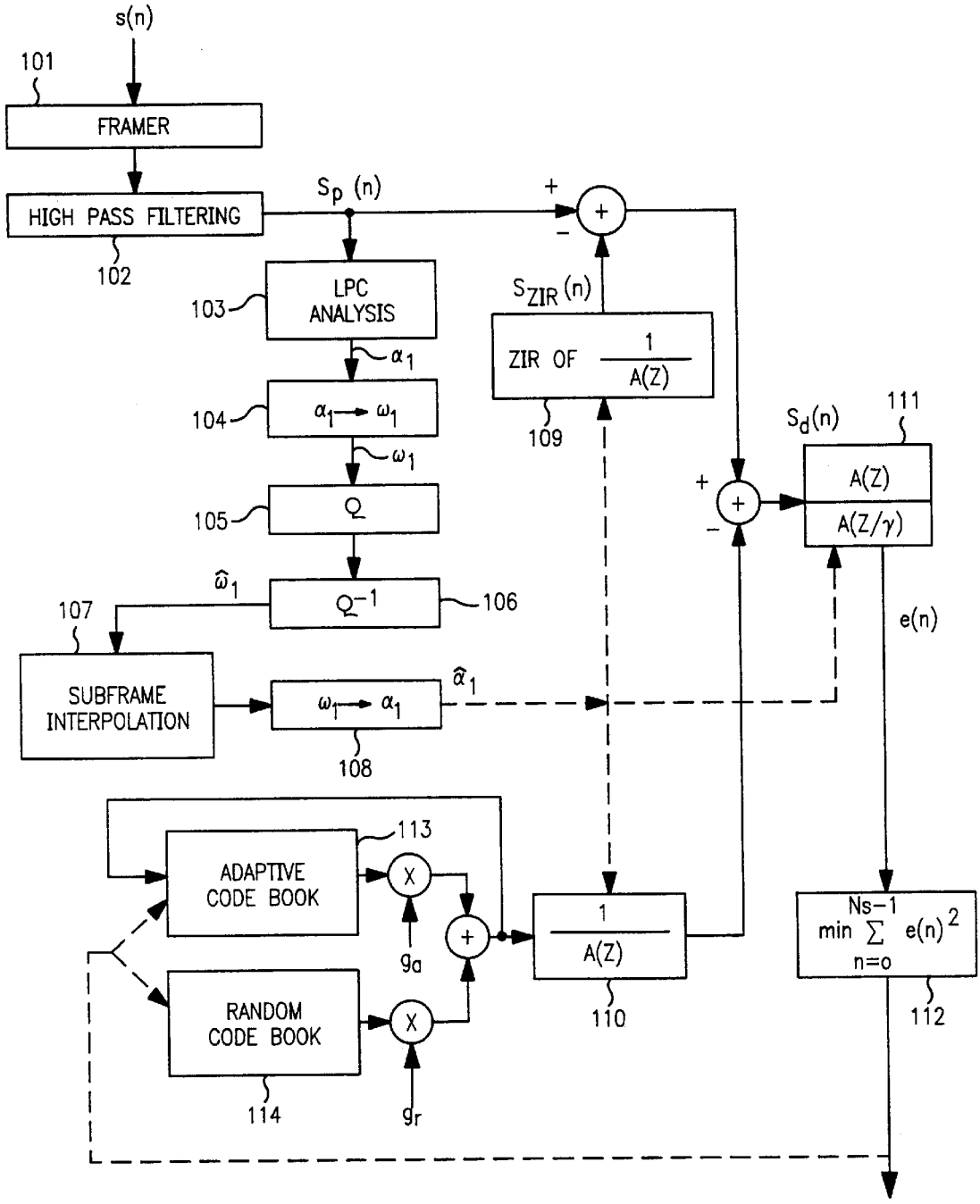
FIG. 1 PRIOR ART
FIG. 1 is a block diagram showing a conventional code-excited linear predictive (CELP) coder for explaining a CELP coding method.
Figure 2:
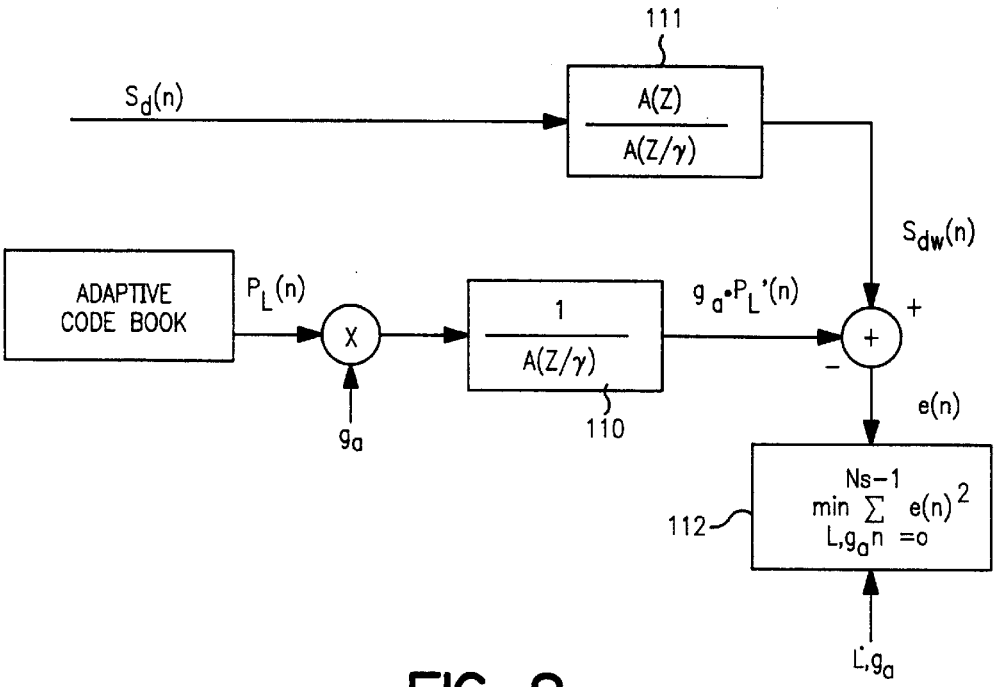
FIG. 2 PRIOR ART
FIG. 2 is a block diagram for explaining the process of generating an adaptive code book.
Figure 3:
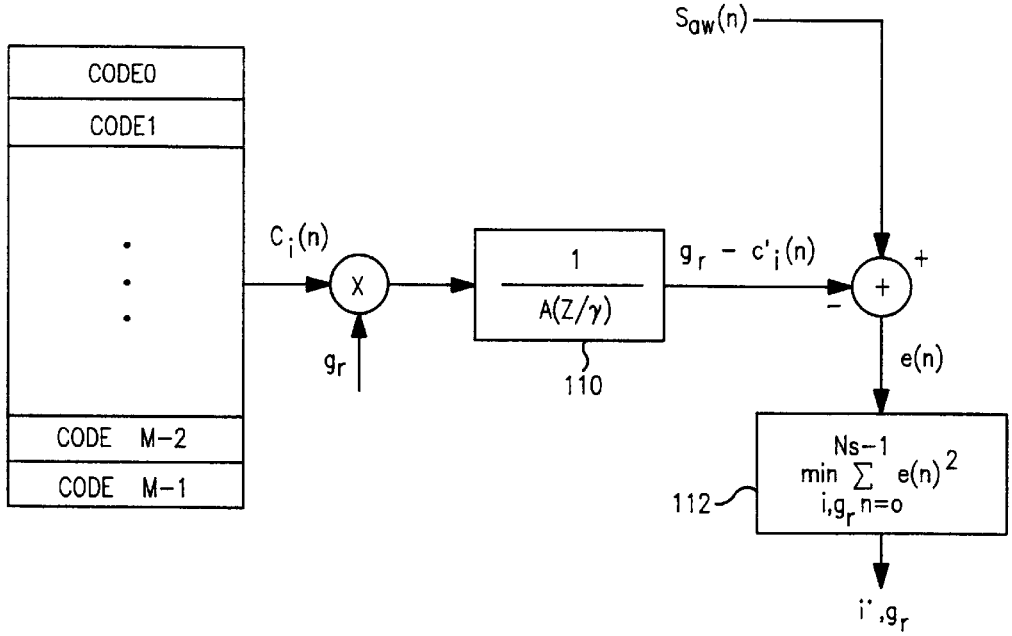
FIG. 3 PRIOR ART
FIG. 3 is a block diagram for explaining the process of generating a random code book.
Figure 4:
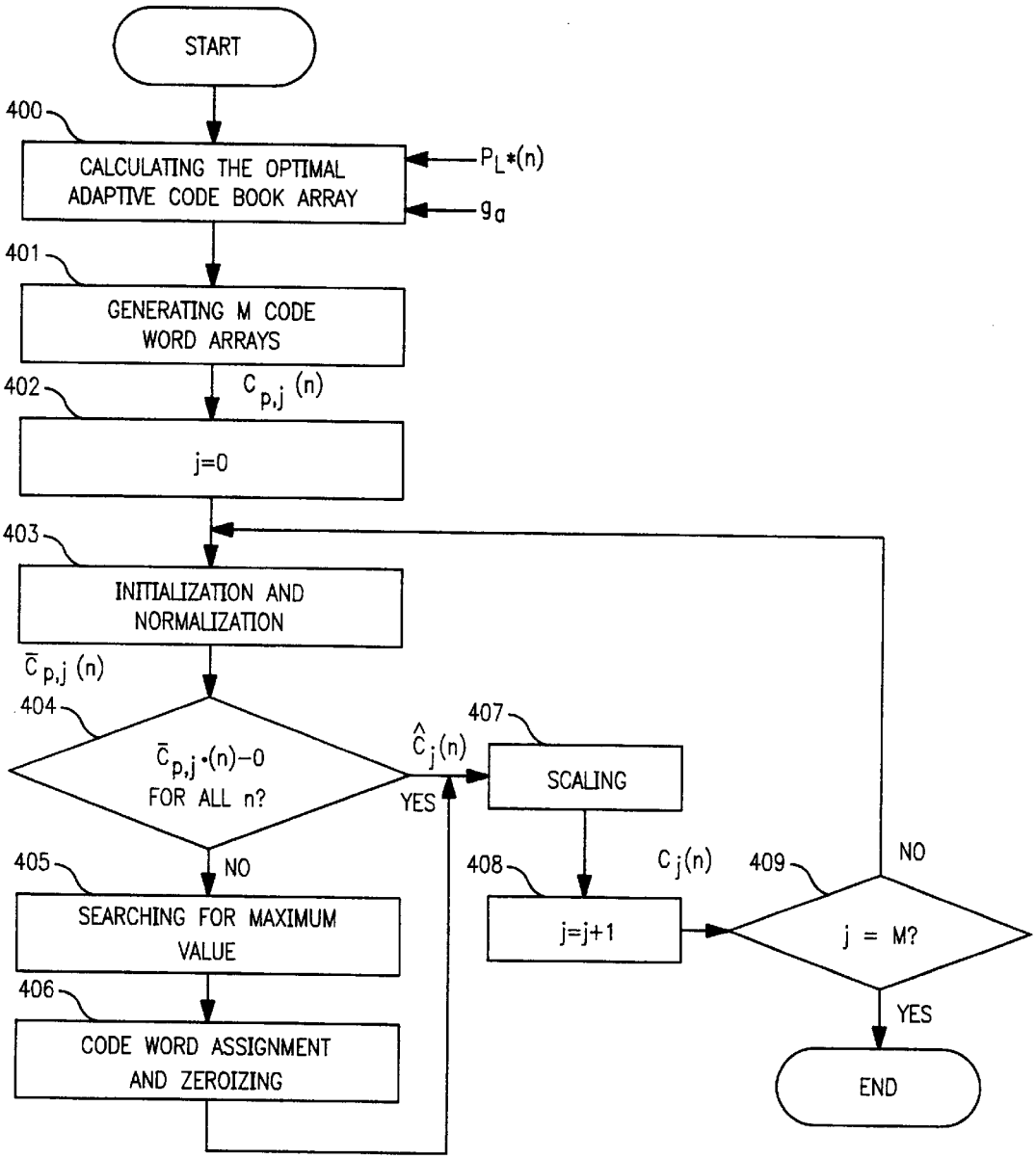
FIG. 4 is a flowchart for explaining a method for generating a random code book according to the present invention.

FIG. 4 shows the generating method of the random code book according to the present invention. Referring to FIG. 4, in step 400, the adaptive code book array with respect to the present subframe is obtained from the optimal lag L. and the optimal gain $g_a$ obtained from the adaptive code book.

$$p(n)=g_a.P_L.(n),\ n=0, \ldots, N_8-1 \tag{15}$$

In step 401 M code word arrays are made by uniting the array of equation (15) and the excitation signal of the past subframe.

$$\hat{P}(n) = \begin{cases} r(n-M+1), & n=0, \ldots, M-2 \\ P(n-M+1), & n=M-1, \ldots, N_s-1 \end{cases} \tag{16}$$

$$C_{p,j}(n)=\hat{P}(n+j),\ j=0, \ldots, M-1,\ n=0, \ldots, N_s-1 \tag{17}$$

Steps 403–407 are performed for all j (j=0, . . . , M−1). In step 403 the final code word is initialized.

$$\hat{C}_j(n)=0,\ n=0,\ldots,N_0-1 \tag{18}$$

The code words of the array generated are in step 401 are normalized. For example, the code word array is searched for the maximum value in $C_{p,j}(n)$ of equation (17). The code word array is divided by the maximum value obtained from the search to normalize the code word array. Accordingly, the normalized code word $\overline{C}_{p,j}(n)$ is as follows.

$$C_{max} = \underset{0 \leqq n \leqq N_s-1}{\text{MAX}} \ |C_{p,j}(n)| \tag{19}$$

$$\overline{C}_{p,j}(n) = \frac{C_{p,j}(n)}{C_{max}}, \quad n = 0, \ldots, N_s - 1 \tag{20}$$

Step 404 is a process in which the end of repeated process with respect to respective j is checked, which will be explained after step 406.

In step 405 the n which has normalized code words maximum value among the $\overline{C}_{p,j}(n)$ is searched.

$$n_{max} = \underset{0 \leqq n \leqq N_s-1}{\text{ARGMAX}} \ |\overline{C}_{p,j}(n)| \tag{21}$$

The value of equation (20) at $n_{max}$ is assigned to $\hat{C}_j(n)$.

$$\hat{C}_j(n)=\overline{C}_{p,j}(n),\ n=n_{max} \tag{22}$$

In step 406, 0 is assigned to the $\overline{C}_{p,j}(n)$ as follows.

$$\overline{C}_{p,j}(n)=0,\ \max(0, n_{max}-5)\leqq n\leqq \min(n_{max}+5, N_s-1 \tag{23}$$

Accordingly, in $\overline{C}_{p,j}(n)$, a maximum of 11 samples are changed to 0.

In step 404 it is checked if there is a non-zero sample among the samples in $\overline{C}_{p,j}(n)$. If all the samples are 0, step 407 is performed.

In step 407 the size of code word is adjusted, and scaling is performed on the basis of the power of the immediately previous subframe.

$$P_c = \sum_{n=0}^{N_n-1} \hat{C}_j(n) \cdot \hat{C}_j(n) \tag{24}$$

$$P_{-1} = \sum_{n=-N_s}^{1} r(n) \cdot r(n)$$

$$C_j(n) = \sqrt{\frac{P_{-1}}{P_c}} \cdot \hat{C}_j(n), \quad n = 0, \ldots, N_s - 1$$

The j-th code word obtained finally becomes $C_j(n)$.

In step 409 it is determined if the generation of M code words is completed, and if the generation is completed, the process is stopped.

As described above, since in the method for generating a random code book according to the present invention, the random code book is generated by using adaptive code book information, it has the effect that it can provide improved synthesized sound as compared with the conventional CELP coder.

In addition, it has the effect that the size of random code book is reduced by generating random code book appropriate to the characteristic of a voice to be analyzed and modeling the voice.

Moreover, it has the advantage that quantization with respect to the random code book gain becomes easy using size information of the previous subframe in generating the random code book.

What is claimed is:

1. A method for generating a random code book having a characteristic similar to a periodic component of each frame of a voice signal in a code-excited linear predictive (CELP) coding method, the method comprising:

generating an adaptive code book for removing a periodic component of a current subframe of a voice signal;

determining an optimal delay and an optimal gain associated with each code word of the adaptive code book to minimize a difference signal between each code word and the voice signal;

generating an adaptive code book array with respect to the current subframe from the optimal delay and the optimal gain;

generating a number of code word arrays from the adaptive code book array and an excitation signal of an immediately previous subframe with respect to the current subframe;

selecting a code word which has a maximum value in each code word array and normalizing each code word array using each selected code word;

selecting a normalized maximum value in each normalized code word array, scaling each normalized maximum value by the power of the most previous subframe; and generating a random code book comprising a set of the scaled normalized maximum code word values based on a periodic component of each frame of the voice signal.

2. The method for generating a random code book as claimed in claim 1, wherein normalizing each code word array comprises zeroing the code words before and after a code word having the maximum value in each code word array.

3. The method for generating a random code book as claimed in claim 2, wherein zeroing the code words before and after the code word having the maximum value in each array comprises zeroing no more than five code words having the maximum value and five code words after the code words having the maximum value.

* * * * *